US006682618B1

(12) United States Patent
Bowers

(10) Patent No.: US 6,682,618 B1
(45) Date of Patent: Jan. 27, 2004

(54) YARN WITH HEAT-ACTIVATED BINDER MATERIAL AND PROCESS OF MAKING

(75) Inventor: Charles Edward Bowers, Hopewell, VA (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 08/933,822

(22) Filed: Sep. 19, 1997

Related U.S. Application Data

(63) Continuation-in-part of application No. 08/792,819, filed on Jan. 30, 1997, now abandoned, which is a continuation of application No. 08/516,506, filed on Aug. 17, 1995, now abandoned, which is a continuation of application No. 08/067,413, filed on May 25, 1993, now abandoned, which is a continuation of application No. 07/436,962, filed on Nov. 15, 1989, now abandoned, which is a continuation of application No. 06/934,389, filed on Nov. 24, 1986, now abandoned.

(51) Int. Cl.[7] ..... D02G 3/40

(52) U.S. Cl. ..... 156/72; 57/238; 57/244; 57/251; 57/256; 428/377; 428/395

(58) Field of Search ..... 57/238, 244, 251, 57/252, 328, 256; 156/72, 148; 428/377, 395

(56) References Cited

U.S. PATENT DOCUMENTS

| | | | | |
|---|---|---|---|---|
| 2,252,999 A | | 8/1941 | Wallach | |
| 2,880,112 A | | 3/1959 | Drelich | |
| 3,494,819 A | | 2/1970 | McAlister | |
| 3,494,822 A | | 2/1970 | Weldon | |
| 3,828,542 A | | 8/1974 | Boutonnet et al. | |
| 3,877,214 A | | 4/1975 | Van der Werf | |
| 3,978,267 A | | 8/1976 | Selwood | |
| 3,978,647 A | | 9/1976 | Kosaka et al. | |
| 3,987,615 A | * | 10/1976 | Hill, Jr. | |
| 4,231,169 A | | 11/1980 | Toyama et al. | 428/408 |
| 4,307,566 A | | 12/1981 | Hurata et al. | |
| 4,355,592 A | | 10/1982 | Tajiri et al. | |
| 4,412,877 A | * | 11/1983 | Vosburgh | 428/95 |
| 4,424,250 A | | 1/1984 | Adams | |
| 4,495,758 A | | 1/1985 | Stahlecker et al. | |
| 4,541,231 A | * | 9/1985 | Graham, Jr. et al. | |
| 4,552,603 A | | 11/1985 | Harris, Jr. et al. | |
| 4,601,949 A | | 7/1986 | Bach et al. | |
| 4,644,741 A | * | 2/1987 | Gradinger et al. | |
| 4,668,552 A | | 5/1987 | Scott | 428/92 |
| 4,668,553 A | | 5/1987 | Scott | 428/92 |
| 4,690,860 A | | 9/1987 | Radvan et al. | 428/290 |
| 4,851,501 A | | 7/1989 | Lubowitz et al. | 428/290 |
| 4,861,649 A | | 8/1989 | Browne | 428/911 |
| 4,871,604 A | | 10/1989 | Hackler | 428/96 |
| 4,916,000 A | | 4/1990 | Li et al. | 428/911 |
| 4,943,472 A | | 7/1990 | Dyksterhouse et al. | 428/288 |
| 5,478,624 A | * | 12/1995 | Lofquist | |
| 5,567,256 A | * | 10/1996 | Queen et al. | 156/72 |

FOREIGN PATENT DOCUMENTS

| | | | | |
|---|---|---|---|---|
| EP | 0444637 | | 2/1991 | |
| EP | 0466618 | | 7/1991 | |
| FR | 2124919 | | 9/1972 | |
| GB | 1168404 | | 10/1969 | |
| GB | 1208293 | | 10/1970 | |
| GB | 2205116 | | 11/1988 | |
| GB | 2205116 A | * | 11/1988 | D02G/3/40 |
| JP | 52-18835 | | 5/1977 | |
| JP | 60-224831 | | 11/1985 | |
| JP | 61-100222 | | 5/1986 | |
| JP | 61-100223 | | 5/1986 | |
| JP | 61-245322 | | 10/1986 | |
| JP | 09119034 | | 5/1997 | |
| WO | 88/03969 | * | 6/1988 | |
| WO | WO 94/20657 | | 9/1994 | |
| WO | WO 95/30040 | | 11/1995 | |
| WO | WO 9914408 | | 3/1999 | |
| ZA | 72-0545 | | 1/1972 | |

* cited by examiner

*Primary Examiner*—Sam Chuan Yao
(74) *Attorney, Agent, or Firm*—Virginia Szigeti

(57) ABSTRACT

Yarn suitable for tufting comprises a base fiber ring spun or wrap spun with a second fiber at least partially comprising a heat-activated adhesive material such that the yarn includes from 0.1 to 12, preferably 0.25 to 10, weight percent adhesive material having a melting point within the range of 105° to 190° C., more preferably 165° to 190° C. A preferred base fiber is a synthetic staple fiber bundle. A preferred wrapping or insert fiber is a copolyamide fiber, including ternary copolyamides of the 6/66/12 type. When the yarn is twist set by conventional processes and then tufted into carpet, the resulting carpet displays enhanced wear and appearance properties.

5 Claims, No Drawings

YARN WITH HEAT-ACTIVATED BINDER MATERIAL AND PROCESS OF MAKING

This is a continuation-in-part application of Ser. No. 08/792,819 filed Jan. 30, 1997 now abandoned, which is a continuation of Ser. No. 08/516,506 filed Aug. 17, 1995 (abandoned) which is a continuation of Ser. No. 08/067,413 filed May 25, 1993 (abandoned) which is a continuation of Ser. No. 07/436,962 filed Nov. 15, 1989 (abandoned) which is a continuation of Ser. No. 06/934,389 filed Nov. 24, 1986 (abandoned).

FIELD OF THE INVENTION

The invention relates to yarn suitable for tufting, especially to form carpet face fiber, and other applications. The yarn comprises a blend of fibers including a first, preferably synthetic, base fiber, ring spun or wrap spun with a second fiber that at least partially comprises a heat-activated adhesive material having a melting point substantially below that of the base fiber. In a process for production of a yarn suitable for tufting, particularly for use in a carpet, exposure of the yarn to usual process conditions for twist setting the yarn causes the heat-activated adhesive material in the inserting or wrapping fiber, as appropriate, to melt substantially completely and flow to points of intersecting base fiber filaments to create a bond upon subsequent cooling, thus altering properties and performance of the resulting product.

DESCRIPTION OF RELATED ART

It has been known to blend non-adhesive fibers with potentially adhesive fibers to form a yarn or other textile structure or article, then to activate the potentially adhesive fibers to bond them to contacting fibers, thus modifying end-use properties of the yarn. U.S. Pat. No. 2,252,999 to Wallach, issued Aug. 19, 1941, provides a process wherein a yarn comprising an admixture of non-adhesive and potentially adhesive fibers is formed, the potentially adhesive fiber is activated, and the fibers compacted while in an adhesive condition so that they adhere to each other at points of contact U.S. Pat. No. 3,877,214 to Van der Werf, issued Apr. 15, 1975, discloses a twist-free yarn comprising a polyamide fiber melting under a relatively low temperature as a bonding component. U.S. Pat. No. 3,494,819 to McAlister, issued Feb. 10, 1970, discloses a blend of fusible and non-fusible polyethylene terephthalate fibers incorporated into fabric, wherein the finished fabric is heated to fusion temperatures to provide improved pill resistance U.S. Pat. No. 3,978,267 to Selwood, issued Aug. 31, 1976, discloses a substantially twistless compact yarn comprising a proportion of potentially adhesive fiber which has been activated to bond contacting fibers.

Cut-pile carpet is customarily produced from staple yarns or bulked continuous filaments yarns. For example, staple fiber is conventionally carded, pinned, and spun or wrap spun into a singles yarn, which typically is twisted and plied with similar yarn to form a 2-ply or 3-ply yarn construction. This yarn is twist set by utilizing one of several commercially available twist setting processes such as the Suessen or Superba processes.

In a typical process the yarn is passed through a heated chamber, while in a relaxed condition. The temperature of this process step is crucial to the proper twist setting of the base fiber, to obtain desired properties of the final carpet product. For nylon-6 base fiber, the conditions for this step are typically 190–200° C. with a residence time of about 60 seconds for the Suessen process and about 125–140° C. with a residence time of about 60 seconds for the Superba process. The Superba process utilizes saturated steam and thus the yarn is subjected to a much higher level of humidity than in the Suessen process.

Similarly, bulked continuous filament yarn is produced according to various conventional methods. Twisting, entangling, or direct cabling may be utilized in various processes. For example, a 2-ply twisted yarn combining 2 ends of 1185 denier 70 filament nylon-6 yarn is prepared and subjected to conventional twist setting conditions, such as that for the staple yarn above, or in an autoclave at 132° C. in saturated steam with a residence time of about 40 to 60 minutes.

It is known to wrap fiber, both staple and continuous filament, with a binder strand to physically bind the wrapped fiber to permit downstream processing. See, e.g., U.S. Pat. No. 4,495,758 to Stahlecker et al. and U.S. Pat. No. 4,668,553 to Scott et al. Neither of these patents, however, uses or suggests the use of a binder strand or fiber that contains heat-activated adhesive material.

Multiple ends of the twist set yarns are tufted into cut pile carpet and conventionally finished to obtain the desired carpet product.

SUMMARY OF THE INVENTION

Yarn, preferably synthetic, comprises at least one bundle of fiber, the fiber being ring spun or wrap spun with a second fiber (either an insert fiber in the case of ring spun or a wrapping fiber in the case of wrap spun) comprising a heat-activated binder material, preferably a fiber, having a melting point range of about 105 to 190° C., preferably 165 to 190° C., under ambient humidity conditions, such that the yarn comprises a total of 0.1 to 12, preferably 0.25 to 10, more preferably 0.5 to 8, weight percent binder material. The preferred fiber bundle comprise staple fibers, preferably in the form of a silver. Alternatively the bundle of fibers may be continuous filaments. The preferred second, binder fiber is a copolyamide, more preferably a copolyamide of the nylon 6/nylon 6,6 type. The preferred bundle of fiber is nylon 6. The present invention is also an article, preferably tufted, more preferably a carpet, made from this yarn. The present invention is also a process of producing a yarn suitable for tufting; the process comprising the steps of:

a. forming a bundle of fiber, preferably by spinning staple fiber;

b. ring spinning or wrap spinning the bundle of fiber with a second fiber comprising a heat-activated binder material having a melting point range of about 105 to 190° C., preferably 165 to 190° C., under ambient humidity conditions to form a yarn comprising 0.1 to 12, preferably 0.25 to 10, more preferably 0.5 to 8, weight percent of the binder material;

c. heating the yarn sufficiently to melt the binder material; followed by d. cooling the yarn, preferably during twist setting, to solidify the binder material.

With ring spinning, the insert fiber is inserted before the front delivery roll into a continuous bundle of base fibers, preferably staple fibers in a silver. This invention also relates to yarn made in accordance with the aforesaid process.

When the yarn is twisted, plied and twist set by conventional processes, for example 190–200° C. Suessen twist-setting with a residence time of about 60 seconds, and the treated yarn tufted into cut-pile carpet, the resulting carpet displays enhanced carpet tuft appearance, improved resilience, and reduced change of appearance with use.

DESCRIPTION OF THE PREFERRED EMBODIMENT

Applicant has discovered that by incorporation of a minor proportion of heat-activated binder fiber having substantially lower melting point than the base fiber into the yarn construction, the standard heat conditions for twist setting the yarn will cause the binder fiber to melt, substantially losing its identify as a fiber. It will flow to intersecting points of the base fiber and upon subsequent cooling will encapsulate and bind fibers and yarn together, thereby retaining the twist in cut-pile carpets. Carpets made with the yarn of this invention can be improved in surface, aesthetics, hand, durability and wear performance. By careful selection of the binder fiber desired improvement is "built-in" to the yarn, with no additional process steps required by the yarn spinner, the carpet manufacturer, or in dyeing and finishing.

The base fiber is selected from known synthetic fibers suitable for carpet use; such as, polyamides, nylon-6 and nylon-6,6, polyesters, and polyolefins, as well as material fibers, such as cotton and wool.

The binder fiber is selected to provide good adhesion to the base fiber. It is important that the melting point of the binder fiber be in the range of 105–190° C., preferably 165–190° C., under ambient humidity conditions. This range ensures that the binder fiber will melt during the conventional twist setting process yet will provide adequate adhesive properties during any subsequent dyeing steps and final use. A saturated steam environment, such as in an autoclave, reduces the fiber melting point of polyamide binder fibers dramatically.

A preferred class of binder fiber for use with polyamide base fibers are copolyamides within the specified melting point ranges. Suitable copolyamides of the 6/66/12 type and a process for their production are disclosed in U.K. Patent 1,168,404, issued Oct. 22, 1969 to Inventa A. G., incorporated herein by reference. A melt bonding copolyamide adhesive fiber is commercially available from EMS as GRILON® type K 140 (melting range 130–140° C.) and type K 115 (melting range 110–117° C.) copolyamides of the 6/66 Type as in U.S. Pat. No. 5,478,624 to Lofquist.

The binder fiber can be blended, wrapped around, or inserted into base fibers, and the resulting fiber blend can then be processed in known ways. It is important to ensure a thorough blending when the binder fiber is blended with base staple fiber to avoid potential clumps in the finished carpet. The fiber blend should contain 0.1–12 weight percent binder fiber, preferably 0.25 to 10 weight percent, and more preferably 5 to 8 weight percent. Higher amounts cause undesirable harshness of hand due to the conditions of the twist setting process causing the binder fiber to melt substantially completely. Ring spun or wrap spun yarns prepared from such a fiber blend and subjected to thermal activation can provide strength properties approaching that of bulked continuous filament (BCF) yarns. Properties of BCF yarns can also be enhanced.

By selection of the thermally activated binder fiber within the weight percent ranges and melting point ranges specified it is possible to modify end-use properties of the finished carpet to improve wear resistance, resilience, reduced change of appearance over time and with use, and to increase hand, lustre and apparent value. Denier per filament, cut length, fiber cross-section, crimp type and frequency, surface finish, melt viscosity, softening point, melting point, dye affinity, and other properties are crucial to achieving ideal properties in the final product. A proper selection of the binder fiber must be made to obtain the desired, or optimum results from the finished carpet product. This will depend on numerous factors including the denier, length, crimp, finish, and other properties of the base fiber product.

With the utilization of this invention, twist setting conditions normally used are sufficient to activate the binder fiber, to create bind points which strengthen the final product, thereby imparting other characteristics which are desirable. For the Suessen process, under relatively low humidity conditions, the twisted yarn is subjected to a temperature of 190–205° C. for a residence time of 50–60 seconds. In the Suessen process motion of the fiber while in the relaxed state, caused by vibration or air currents, sufficiently motivates the molten binder fiber to flow to the intersecting "touch points" of the base fiber, as a function of the melt flow properties of the binder fiber and surface characteristics. As the fiber emerges from the elevated temperature condition, the binder solidifies and encapsulates or bonds two or more base fibers together at intersecting points in a durable bond. Subsequent processing including dyeing, finishing, and backcoating using commercial processing methods does not soften the bond points sufficiently to weaken them, but rather will strengthen them. The resultant carpet can be of many forms, but a typical style would be cut-pile carpet with about 40 ounces per square yard of face yarn including the binder, with an attached backing. Carpet construction would be typically 5/32" gauge, ¾" pile height, and the carpet would be dyes, dryed, backcoated, and sheared using normal processing techniques. The yarn of the invention would also provide important property improvements in the production of loop-pile carpet.

EXAMPLE 1

A blend of staple fiber was produced with 3 weight percent GRILON® Type K 140 copolyamide fiber having a melt point range of 130–140° C. and 97 weight percent base stapler fiber (AlliedSignal Type 521 nylon-6 fiber having a melt point range of 215–225° C.).

The blended fiber was carded, pinned, and ring spun into a singles yarn by conventional processing methods. The yarn, a 3.0/1 cotton count yarn containing 4.7 "Z" twists per inch, was plied with a similar yarn to produce a 2-ply 3 0/2 cotton count 4.7Z×4.0S yarn. The 2-ply yarn was twist set by a conventional Sussen twist setting process. The yarn was passed through a heated chamber at about 195° C. while in a relaxed condition, with a residence time of about 60 seconds.

Multiple ends of this yarn was tufted into cut pile carpet and conventionally finished to obtain the improved product.

The resulting carpet was compared to a control carpet prepared in the same manner from 100 percent base staple fiber. The carpet containing the binder staple fiber blend displayed enhanced carpet tuft appearance, more resilience, and better wear resistance.

EXAMPLE 2

Carpets also may be produced from bulked continuous filament (BCF) yarns, and carpets thus made can be improved in surface, aesthetics, hand, or in durability and wear by using this invention. In the following example the carpet manufacturer simply uses normal processing techniques to obtain the desired effect.

Filament nylon yarn is produced according to various conventional fiber producer manufacturing methods. These methods are not particularly related to the invention, except that another, smaller, filament yarn will accompany a base yarn throughout subsequent process steps. Often the combination will result in a 2-ply, 3-ply, or other form needed for the carpet style.

In various processes, twisting, entangling, or direct cabling may be utilized. Direct cabling is often used, as in this example, where a 70 denier 14 filament yarn is combined with a 1185 denier 70 filament in the creel of the direct cabler to produce a yarn with 3.5 "S" twist per inch in each of the singles and 3.5 "Z" twist in the resultant 2-ply twisted yarn (1185×2 ply). The final yarn contains a third component, a binder yarn, which as a lower melting point and which will lose much of its identity in subsequent process steps, as it is melted and flows to bind fibers and yarn together, thereby retaining the twist in cut pile carpet.

In this example, the 70 denier 14 filament yarn is a copolyamide having a melt point range of 105–180° C. and results in the binder fiber for the combination, combined with 2 ends of 1185 denier, providing a blend of about 2.8 percent binder. This ratio can be doubled by using two binder yarn ends, or varied by providing other denier products to the system.

When the product is subjected to conventional twist setting, the binder is activated producing a final product with the desirable characteristics of enhanced carpet tuft appearance, more resilience, and better wear resistance than similar carpets not containing the binder. The twist setting conditions for this are typically 270° F., in saturated steam, with a residence time of about 30–50 seconds for the superba twist set process or 40–60 minutes for the autoclave twist set process. As the fiber emerges from the elevated temperature condition, the binder solidifies and encapsulates or bonds two or more base yarns together in a permanent or durable bond.

Multiple ends of these yarns are tufted into cut pile carpet and conventionally finished to obtain the improved product.

EXAMPLE 3

Carpets also may be produced by introducing a binder yarn as the wrapper yarn that is placed uniformly around a continuous bundle of base staple fibers at wrap (hollow spindle) spinning to produce a wrap spun yarn. The binder yarn can consist of 100% heat-activated adhesive fibers or consist of a blend of heat activated adhesive fibers and non-adhesive fibers. Binder yarns as such can be either continuous filament yarn or spun staple yarn produced by conventional manufacturing methods.

When the resulting wrap spun yarn is twisted into a plied yarn, twist set by conventional process, and the treated yarn tufted into cut-pile carpet, the carpet displays enhanced carpet tuft appearance, more resilience, and better wear resistance than similar carpets not containing the binder yarn. These carpet improvements can be further enhanced by the continuous bundle of base staple fibers being a blend with a low weight percent of heat activated adhesive fibers and a high weight percent of non-adhesive fibers that is wrapped with a binder yarn as described above.

In this example, the continuous bundle (silver) of base staple fibers is 100% 17 denier per filament AlliedSignal T317 nylon-6 staple fibers that is wrapped with a 30 denier 12 filament yarn at wrap spinning to produce a 3 35/1 cotton count yarn containing 5.2 "Z" wraps per inch. This singles yarn is then plied with another singles end of the same yarn to produce 3.35/2 cotton count 5.2 Z wraps per inch×5.4 S twists per inch final yarn. This final yarn contains a binder yarn, which is the 30 denier 12 filament yarn wrapped around each end of the 2 plies. This 30 denier yarn is a copolyamide nylon having a melt point range of 105–180° C. The remainder of the 3.35/2 cotton count yarn is AlliedSignal T317 nylon-6 staple fibers having a melt point range of 215–225° C., which results in a blend of about 2.0 percent binder. This ratio can be increased by using a larger denier binder yarn, or by a low weight percent of heat-activated adhesive fibers and a high weight percent of non-adhesive AlliedSignal T317 nylon-6 staple fibers blend being in the continuous bundle (sliver) of base staple fibers, before wrap spinning, that is wrapped with the 30 denier 12 filament binder yarn.

This final 3.35/2 cotton count yarn was twist set by a conventional stuffer box Suessen twist setting process. The yarn was passed through a heated chamber at 190° C., while in a relaxed condition, with a residence time of 60 seconds. Multiple ends of this yarn were tufted into cut-pile carpet and conventionally finished to obtain the improved product. The resulting carpet was compared to a control carpet prepared in the same manner from 100 percent non-adhesive AlliedSignal T317 nylon-6 base staple fibers. The carpet containing the 2.0 percent wrapper yarn binder displayed tighter and more defined individual pile tufts, a more resilient, stiffer hand, enhanced carpet surface appearance with significantly less hairiness, and better wear resistance.

EXAMPLE 4

Carpets also may be produced by introducing a binder yarn at ring spinning before the front delivery roll into a continuous bundle of base staple fibers being drafted to produce a ring spun yarn. The binder yarn can consist of 100% heat-activated adhesive fibers or consist of a blend of heat-activated adhesive fibers and non-adhesive fibers. Binder yarns as such can be either continuous filament yarn or spun staple yarn produced by conventional manufacturing methods. This ring spun yarn has greater strength due to the added strength of the inserted yarn in the total spun yarn structure, which results in improved operating performance at spinning by reducing single end breakouts.

The resulting ring spun yarn when later twisted into a plied yarn and twist set by conventional processes results in a treated yarn with altered, unique performance properties. The unique properties are produced by the heat activated adhesive fibers in the inserted binder yarn being intermingled within the continuous bundle (sliver) of non-adhesive base staple fibers during the ring spinning process, melting during conventional twist setting processes, and then solidifying when emerging from the elevated temperature forming a durable crossbonding with the non-adhesive base staple fibers within the individual ends of the plied yarn and between the individual ends of the plied yarn.

The treated plied twist set yarn has a more resilient, stiffer hand, significantly improved ply twist retention, and a less hairy surface. When tufted into cut-pile carpet, the hand of the pile is significantly firmer, the individual tufts are tighter and more defined, and the pile surface is cleaner with less hairiness. These carpet improvements can be further enhanced by the continuous bundle of base staple fibers being a blend with a low weight percent of heat-activated adhesive fibers and a high weight percent of non-adhesive fibers in which the binder yarn is inserted as described above.

In this example, a 30 denier 12 filament yarn is inserted before the front delivery roll into the continuous bundle of base staple fibers (sliver) being drafted at ring spinning. The sliver is 100% 17 denier per filament AlliedSignal T317 nylon-6 staple fibers, which is spun into a 3.0/1 cotton yarn containing 4.8 "Z" twists per inch. This singles yarn is then plied with another singles end of the same yarn to produce 3.0/2 cotton count 4.8 Z twists per inch×4.1 S twists per inch final yarn. This final yarn contains a binder yarn, which is the 30 denier 12 filament yarn inserted in each end of the 2 plies. This 20 denier yarn is a copolyamide nylon having a melt point range of 105–180° C. The remainder of the 3.0/2 cotton count yarn is AlliedSignal T317 nylon-6 staple fibers having a melt point range of 215–225° C., which results in a blend of about 1.7 percent binder. This ratio can be increased by inserting a larger denier binder yarn at the front delivery roll, or by a low weight percent of heat activated adhesive fibers and a high weight percent of non-adhesive AlliedSignal T317 nylon-6 staple fibers blend being in the continuous bundle (sliver) of base staple fibers, before ring spinning, in which the 30 denier 12 filament binder yarn is inserted at the front delivery roll of ring spinning.

This final 3.0/2 cotton count yarn was twist set by a conventional Suessen twist setting process. The yarn was passed through a heated chamber at 190° C., while in a relaxed condition, with a residence time of 60 seconds. Multiple ends of this yarn were tufted into cut-pile carpet and conventionally finished to obtain the improved product.

The resulting carpet was compared to a control carpet prepared in the same manner from 100 percent non-adhesive AlliedSignal T317 nylon-6 base staple fibers. The carpet containing the 1.7 percent inserted binder yarn displayed more defined individual pile tufts, a more resilient, stiffer band, and a cleaner, enhanced carpet surface appearance which is more like a BCF cut pile carpet.

What is claimed is:

1. A process for producing a yarn suitable for tufting, said process comprising the steps of:

a. forming a bundle consisting essentially of a first base fiber prior to spinning, said first base fiber being selected from the group consisting of polyamides, polyesters, polyolefins, cotton and wool;

b. ring spinning or wrap spinning the bundle of fiber with a second fiber to form a yarn, said second fiber being twisted or wrapped uniformly around the bundle of fiber and consisting essentially of a blend of a second base fiber and a heat-activated binder material having a melting point lower than that of said bundle of fiber, said yarn comprising 0.1 to 12 weight percent of the binder material;

c. heating the yarn sufficiently to melt the binder material; followed by d. cooling the yarn to solidify the binder material.

2. The process of claim 1 wherein the bundle of fiber is formed by spinning staple fiber.

3. The process of claim 1 wherein the first base fiber is nylon-6 having a melt point range of 215 to 225° C.

4. The process of claim 1 wherein the bundle of a first base fiber is selected from the group consisting of a sliver and a bundle of continuous filaments.

5. The process of claim 1 wherein said heat activated binder material has a melting point range of 105° to 190° C. under ambient conditions.

* * * * *